US006037551A

United States Patent [19]

Fukui et al.

[11] Patent Number: 6,037,551

[45] Date of Patent: Mar. 14, 2000

[54] SAFETY SWITCH

[75] Inventors: Takao Fukui; Naruhito Sasaki, both of Osaka, Japan

[73] Assignee: Idec Izumi Corporation, Osaka, Japan

[21] Appl. No.: 09/030,890

[22] Filed: Feb. 26, 1998

[51] Int. Cl.[7] ..... H01H 27/00

[52] U.S. Cl. ..... 200/43.04; 200/43.07; 200/574

[58] Field of Search ..... 200/47, 43.04, 200/43.07, 529, 573, 574

[56] References Cited

U.S. PATENT DOCUMENTS

| | | | |
|---|---|---|---|
| 4,524,251 | 6/1985 | Schulz | 200/42 R |
| 5,473,127 | 12/1995 | Falcon et al. | 200/43.04 |
| 5,587,569 | 12/1996 | Mohtasham | 200/47 A |
| 5,622,253 | 4/1997 | Wecke et al. | 200/43.07 |
| 5,777,284 | 7/1998 | Mohtasham | 200/43.04 |
| 5,821,484 | 10/1998 | Schulze et al. | 200/17 A |

FOREIGN PATENT DOCUMENTS 6-76674 3/1994 Japan .

*Primary Examiner*—Renee S. Luebke
*Attorney, Agent, or Firm*—Armstrong, Westerman, Hattori, McLeland & Naughton

[57] ABSTRACT

A safety switch in which one piece of cam plate 1 (51) which rotates and moves the operating rod 6 (7) of the contact of the switch portion as the actuator 102 enters the operating portion 111 (511), and the lock plates 2, 3 (lock pieces 52, 53) are arranged on the side of the cam plate 1 (51) to form a lock mechanism for restricting the rotation of the cam plate 1 (51) so that the lock mechanism of the cam plate 1 (51) by lock plates 2, 3 (lock pieces 52, 53) is released and the cam plate 1 (51) is rotated only when the actuator 102 enters, thereby preventing the operating portion from being operated by any tool other than the special-purpose actuator. In one of the specific embodiments, the cam plate 1 is formed with recesses 1*a*, 1*b* and lock grooves 1*c*, 1*d*, and the lock plates 2, 3 are respectively formed with inclined surfaces 2*a*, 3*a* and engaging pawls 2*c*, 3*c* for fitting into the lock grooves 1*c*, 1*d*. The lock plates 2, 3 are formed on each side of the cam plate 1 and rotatably supported to the support frame 11 via spherical fulcrums 2*d*, 3*d* which are integrated on the bottom end of the lock plates 2, 3. Springs are fitted between the lock plates 2, 3 and the support frame 11. In another structure, the cam plate 51 is formed with a recess 51*a* and a lock stepped portion 51*b*, and the lock pies 52, 53 are respectively formed with inclined surfaces 52*a*, 53*a* and engaging pawls 52*b*, 53*b* for latching the lock stepped portion 51*b*. The engaging pawls 52*b*, 53*b* are pressurized against the outer circumferential surface of the cam plate 51 by a spring.

5 Claims, 15 Drawing Sheets

SAFETY SWITCH

BACKGROUND OF THE INVENTION

1. Field of the Invention

The present invention relates to a safety switch which is mounted on the wall surface of a doorway of a room in which, for example, industrial machinery is installed, and which is capable of interrupting the power supply to the industrial machinery, etc. when the door of the doorway is opened.

2. Description of the Related Art

In industrial plants containing heavy machinery, there are hazardous driving zones established because of the likelihood of injuries to workers. Consequently, in order to prevent these dangers, a so-called lock system has been required to be installed, in which driving of the machine is stopped when the door of the doorway in the room or a danger zone is not completely closed.

For such a lock system, conventionally, a system to install limit switches at the sliding portions of the door and to supply power to the industrial machinery installed in the room only when the door closed condition is detected by the limit switches has been adopted.

However, because with this kind of lock system, operation of the machine inside the room is enabled by operating an actuator (section) of the limit switch, there is a defect for a safety countermeasure. To solve this kind of defect, there is proposed a safety switch which has a construction for preventing this kind of erroneous operation (Japanese Non-examined Patent Publication No. Hei 6-76674).

The safety switch of this proposal is a switch which has a construction in which special-purpose actuator fixed to the door enters the operating portion of the switch proper mounted to the wall surface in the circumference of the doorway of the room when the door of the doorway is closed, and with this action, the mobile contact (mobile piece) of the contact block is changed over, and this kind of change-over operation, the circuit connection is changed over to the main circuit side (power supply circuit to industrial machinery), causing the machines inside the room to be ready for operation. Now, there is no special problem in functions, safety, etc. with the safety switch disclosed in Japanese Non-examined Patent No. Hei 6-76674, but recently, as applications of safety switch of this kind are diversified, demands of a small-size safety switch which requires small installation space have increased.

SUMMARY OF THE INVENTION

Under these circumstances, it is the main object of this invention to provide a safety switch which has functions and safety equivalent to or better than those of conventional ones and is small in size.

In order to achieve this object, the safety switch of the first invention comprises an actuator which enters an operating portion of the switch proper, wherein an operating rod of the switch portion moves in response to this, and a contact is changed over, where the actuator has an inserting portion to the operating portion comprising a pressurizing piece as well as a supporting piece which supports both ends of this pressurizing piece and whose top end protrudes ahead of the pressurizing piece, characterized in that the operating portion comprises a first cam plate which rotates in response to the entry of the actuator to displace the operating rod and has a recess and lock groove to which the actuator pressurizing piece fits formed on the outer circumferential surface of the first cam plate, a support frame for supporting both ends of the cam shaft for rotatably supporting this first cam the first lock plate, a member which is located on the side of the first cam plate and can rotate around an axis intersecting the actuator inserting direction and at the same time has the first inclined surface tilted in the actuator inserting direction and the first engaging pawl fitted into the lock groove of the first cam plate formed, and the first spring fitted between the first lock plate and the support frame, characterized in that with the actuator not inserted in the operating portion, the first lock plate is held to the position locked by the first spring, the first engaging pawl is fitted into the lock groove of the first cam plate to restrict rotation of the first cam plate, when the actuator enters, the tip-end protrusion of the supporting piece comes in contact with the first inclined surface to cause the first lock plate to open outwards with the axis as a center, thereby releasing the lock of the first cam plate achieved by the first engaging pawl, and at the same time the first cam plate is rotated by the pressurizing piece and the pressurizing piece fits into the recess formed on the outer circumferential surface of the first cam plate.

By the configuration described above, the first embodiment of the present invention can prevent the operation of the operating portion even if an operating plate other than the special-purpose actuator is inserted in an insertion of the operating portion hole.

That is, in the construction according to the first embodiment, since the rotation of the first cam plate is enabled only when the lock plate is opened outwards to release the lock, even if any tool with a flat tip end such as a screwdriver, etc. is inserted into the operating portion to rotate the first cam plate, the first engaging pawl latches the lock groove of the first cam plate and prevents rotation of the first cam plate.

Since in the construction of the present invention, the cam plate is one piece, the size can be reduced as compared to conventional ones. That is, in the conventional safety switches as in the case of those presented in the Japanese Non-examined Patent Publication No. Hei 6-76674, previously presented, since a three-piece of plate are used and all these cam plate pieces are designed to be rotated with the pressurizing piece of the actuator, the geometry of the actuator is large and the operating portion and switch portion must be increased accordingly, while in the first invention, only a one-piece cam plate is required, and the length of the pressurizing piece of the actuator can be shortened, and the switch can be made compact as much.

Now, in the first invention, the desired object can be achieved by mounting the first lock plate to either the right or the left of first cam plate, but the first lock plate may be mounted on both sides of the first cam plate. It is preferable to mount the first lock plate on both right and left sides of the cam plate because a double lock is applied to the first cam plate and still higher safety can be secured.

In addition, the safety switches with these constructions may be configured in a manner such that the first lock plate is rotatable around two axes perpendicular to each other, and to the operating portion, two actuator insertion holes are provided, whose actuator inserting directions intersect each other, and inserting the actuator into either one of the two insertion holes can release restrictions to rotation of the first cam plate by the first engaging pawl.

When the safety switch is configured in this way, the actuator can be inserted in two directions, and the degree of freedom at the time of mounting increases. In this case, providing an insertion hole of the actuator on the front side of the switch proper can bring the actuator inserting direction and outgoing direction of wiring on the same straight line, contributing to space saving.

In order to achieve the above object, the safety switch according to the second embodiment comprises an actuator which enters an operating portion of the switch proper, wherein an operating rod of the switch portion moves in response to this, and a contact is changed over, where the actuator has an inserting portion to the operating portion comprising a pressurizing piece as well as a supporting piece which supports both ends of this pressurizing piece and whose top end protrudes ahead of the pressurizing piece, characterized in that the operating portion comprises the second cam plate which rotates in response to the entry of the actuator to displace the operating rod and has a recess and lock stepped portion to which the actuator pressurizing piece fits formed on the outer circumferential surface, a second lock plate located on the side of the second cam plate and rotatably supported by the second axis parallel to the center axis of the rotation of the second cam plate, and at the same time has the second inclined surface tilted in the actuator inserting direction and the second engaging pawl latching the lock stepped portion of the second cam plate formed, and the second spring pressurizing the second engaging pawl against the outer circumferential surface of the second cam plate, characterized in that with the actuator not inserted in the operating portion, the second engaging pawl comes in contact with the position opposite to the lock stepped portion on the outer circumferential surface of the second cam plate to restrict rotation of the second cam plate, in that when the actuator enters, the tip-end protrusion of the supporting piece comes in contact with the second inclined surface to release the lock of the second cam plate achieved by the second engaging pawl, and at the same time the pressurizing piece presses the inner surface of the recess of the second cam plate to allow the second cam plate to rotate.

It is same as the first embodiment on in that by configuring as above, the second embodiment can prevent the operation of the operating portion even if any operating plate other than the special-purpose actuator is inserted in the insertion hole.

In the construction according to the second embodiment, since the rotation of the second cam plate is enabled only when the second lock plate is allowed to rotate to separate from the second cam plate and release the lock, even if any tool with a flat tip end such as a screwdriver, etc. is inserted into the operating portion to rotate the second cam plate, the second engaging pawl latches the lock stepped portion of the second cam plate and prevents rotation of the second cam plate.

The construction of the second embodiment is the same as that of the first embodiment in that the cam plate is one piece, and the functions and effects are equivalent to those specified above.

Now, in the second embodiment, the second lock plate may be provided on both right and left sides of the second cam plate, and in this point, as in the first embodiment, it is preferable to provide the second lock plate on both right and left sides to apply a double lock to the second cam plate and still greater safety can be secured.

DETAILED DESCRIPTION OF THE PREFERRED EMBODIMENTS

Figure 1:
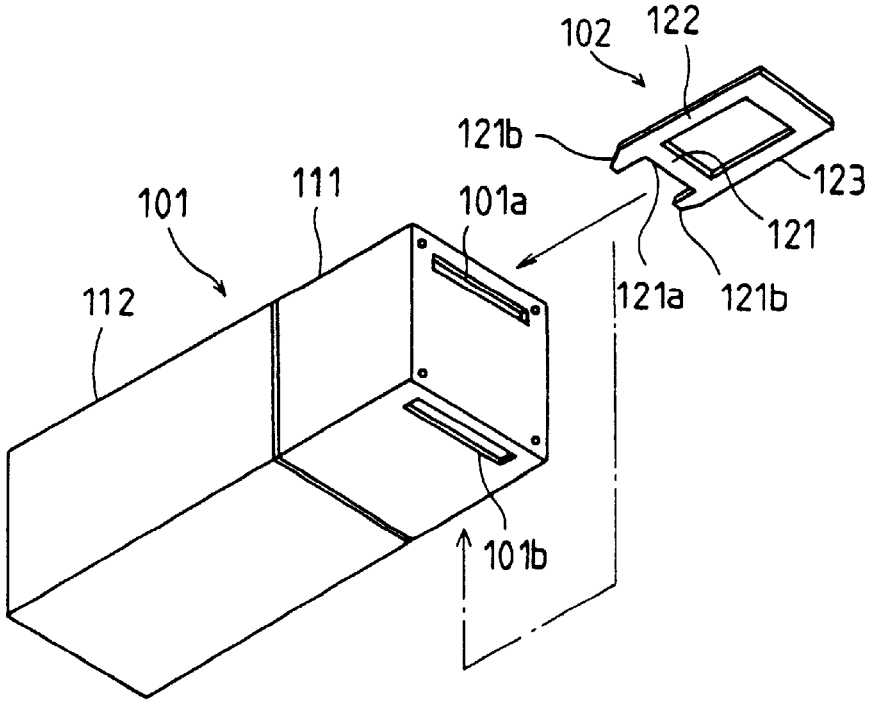
FIG. 1 is an external view in perspective of the first embodiment of the present invention.

Referring now to the drawings, preferred embodiments according to the present invention will be described in detail hereinafter.

Figure 2:
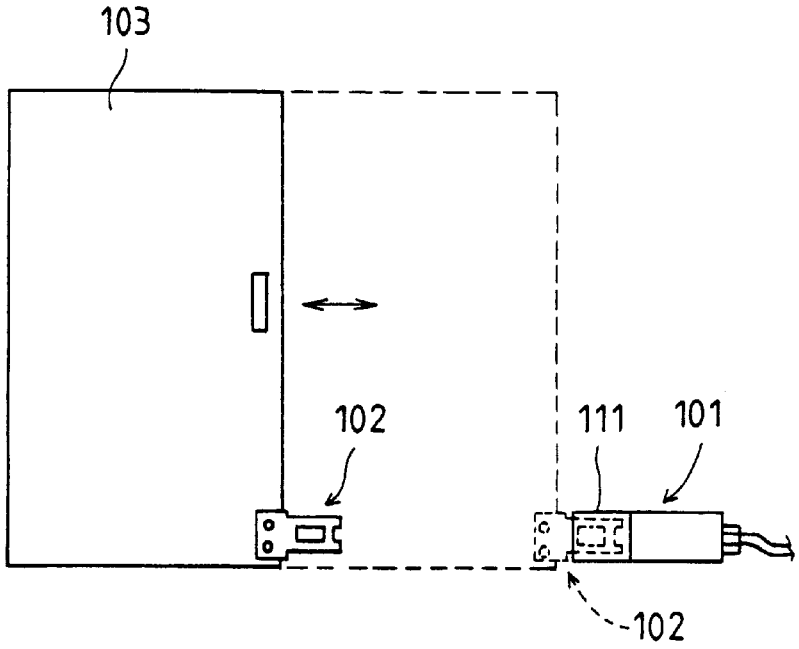
FIG. 2 shows the application condition of the first embodiment.

FIG. 1 is an external view in perspective of the first embodiment according to the present invention, and FIG. 2 shows the application condition of the first embodiment. First of all, referring to FIG. 1 and FIG. 2, the construction of the safety switch according to this embodiment is briefly described.

The safety switch of this example is a switch electrically connected to the industrial machinery installed in a room, and primarily comprises a switch proper 101 and an actuator 102. The switch proper 101 is secured at the wall surface in the periphery of the doorway of the room and the actuator 102 is secured at a door 103. The actuator 102 is located at the position opposite the insertion hole 101*a* of the switch proper and enters the operating portion 111 of the switch proper 101 when the door 103 is closed.

Figure 15A:
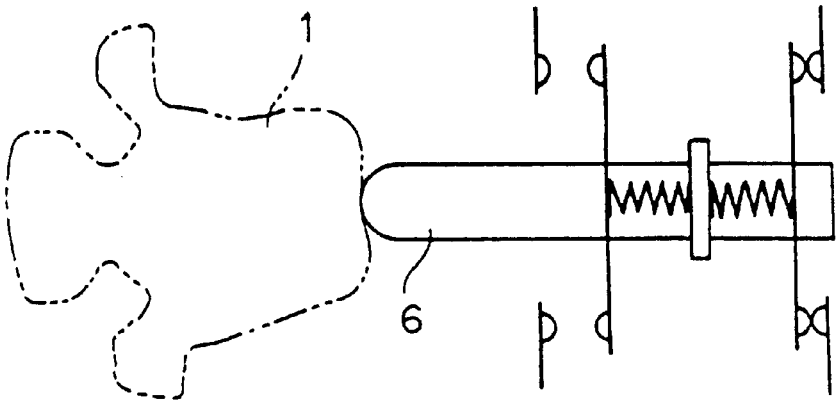
FIG. 15(A) and FIG. 15(B) schematically show a configuration example of the contact block of the switch portion 112 of the first embodiment.
Figure 15B:
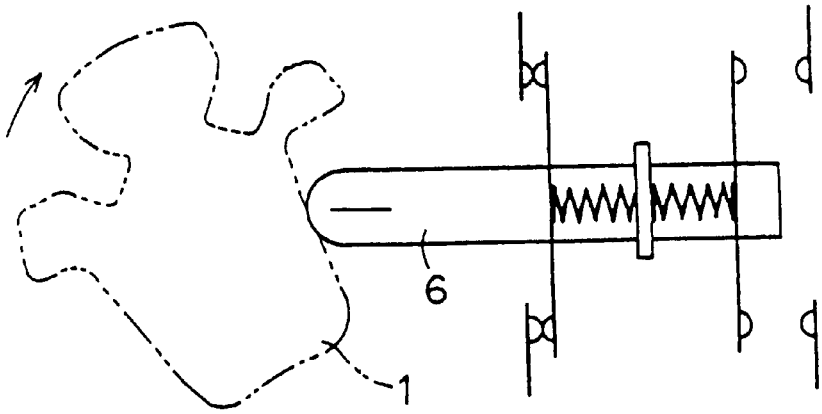

The entry of the actuator 102 changes over the contact of the contact block (see FIG. 15) built in the switch portion 112, and the machinery inside the room is ready for operation. On the other hand, when the actuator 102 is removed from the operating portion 111 by the opening of the door 103, the contact for power supply is changed over and the power supply to the machine is turned off.

The actuator 102 has the insertion portion to the operating portion 111 composed of a pressurizing piece 121 and a pair of supporting pieces 122, 123 for supporting both ends. End portions of the pair of supporting pieces 122, 123 protrude ahead from the pressurizing piece 121, and to the end surface of the actuator 102, two pressurizing surfaces 121*a* and 121*b*, one in recess and the other in protrusion, are formed.

To the switch proper 101, in addition to the insertion hole 101*a* on the front side, an insertion hole 101*b* is provided on the lower surface side of the switch proper 101, so that either insertion hole 101*a* or 101*b* can be chosen in accord with the condition of the location.

Figure 3:
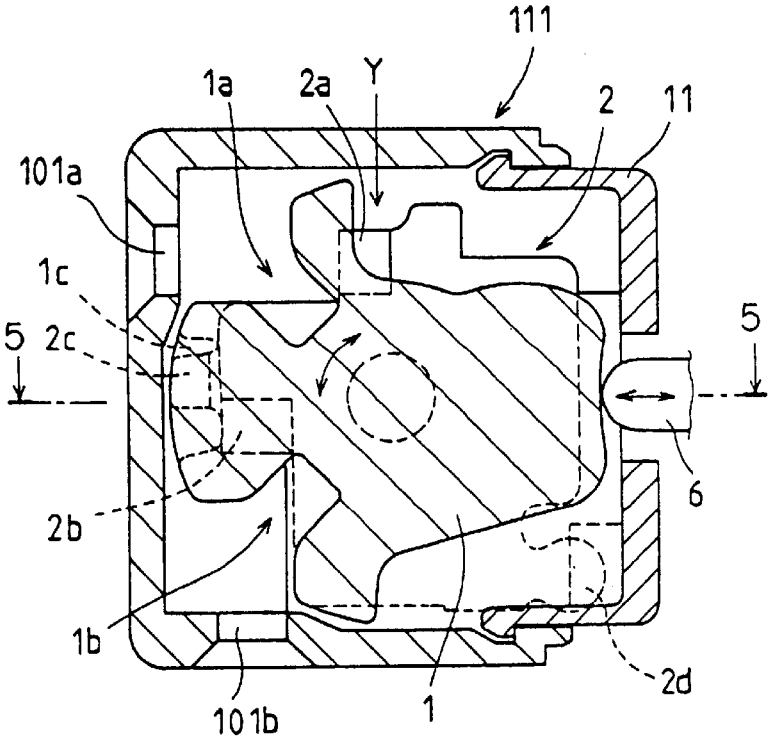
FIG. 3 is a center longitudinal sectional view showing the construction of the operating portion 111 of the first embodiment.
Figure 4:
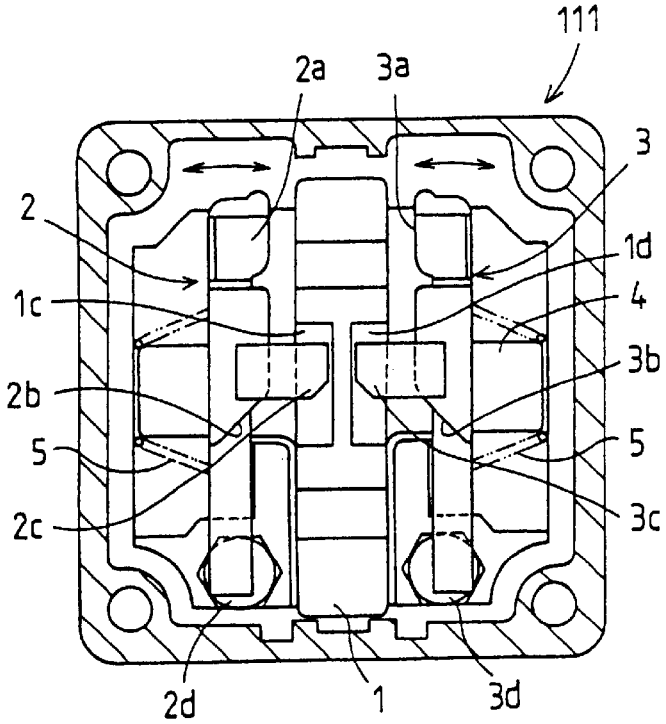
FIG. 4 is a front elevation showing the construction of the operating portion 111 with a cover partly broken away in the first embodiment.
Figure 5:
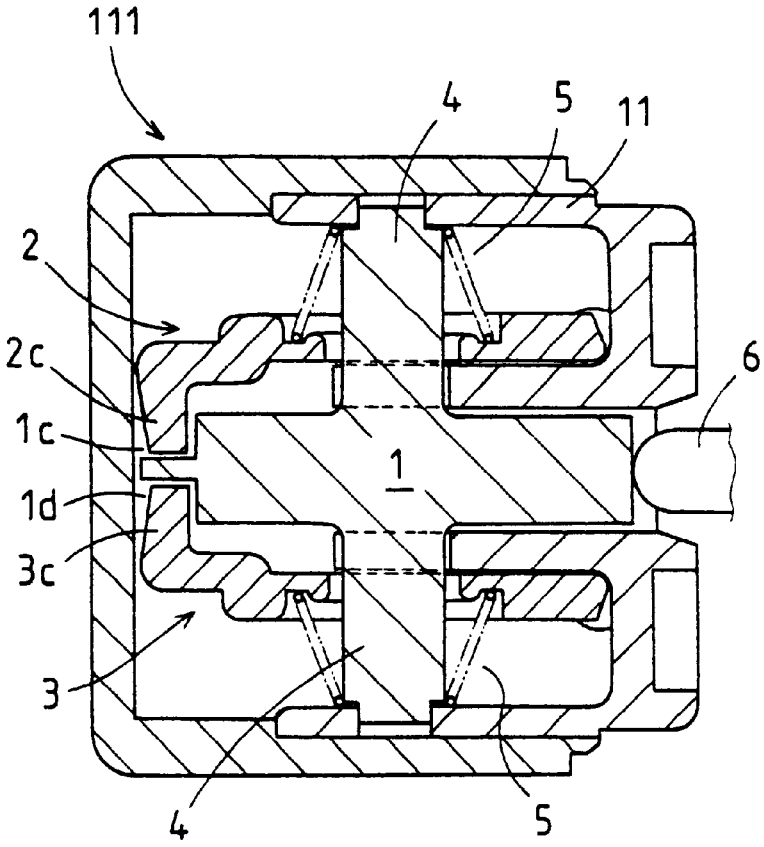
FIG. 5 is a cross-sectional view taken on the lines 5—5 of FIG. 3.
Figure 6:
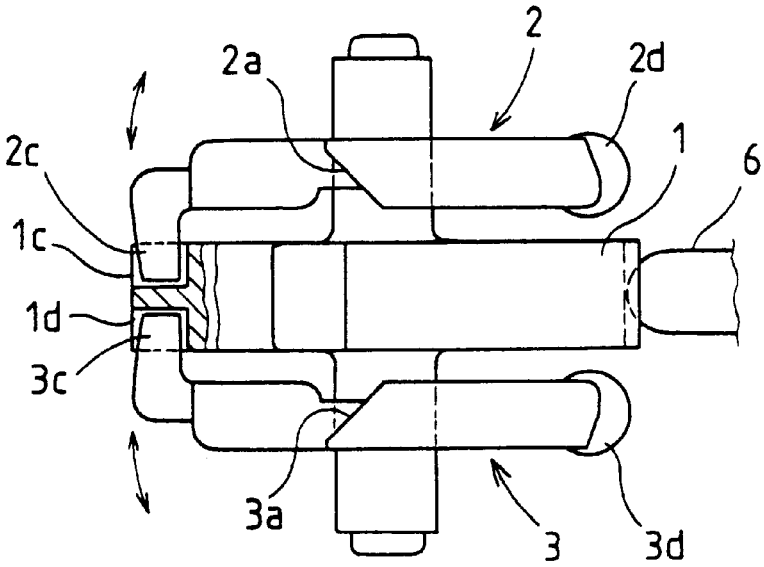
FIG. 6 is a view on arrow Y of FIG. 3.
Figure 27:
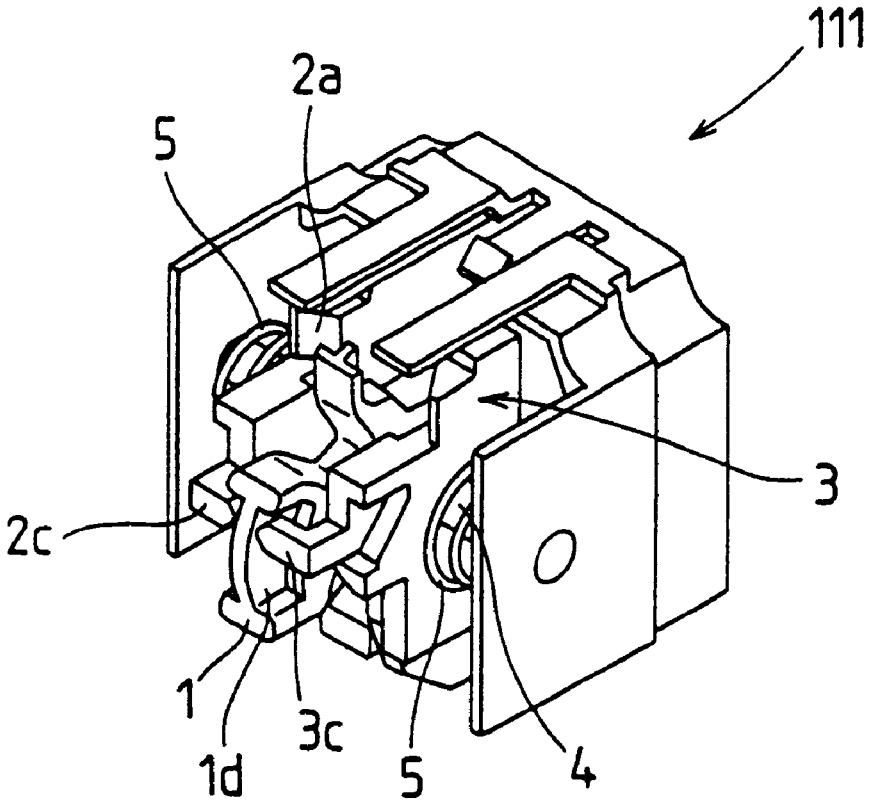
FIG. 27 is a perspective view of the operating portion 111 of the first embodiment.

Referring now to FIG. 3 through FIG. 6, and FIG. 27, the mechanism of the operating portion of this embodiment will be described in detail hereinafter. FIG. 3 is a center longitudinal cross-sectional view, while FIG. 4 is a front elevation with the cover broken away. FIG. 5 and FIG. 6 are a view taken on the line 5—5 and view on the arrow Y of FIG. 3, respectively, and FIG. 27 is a perspective view of the operating portion 111.

To the operating portion 111, a cam plate 1 is mounted. This cam plate 1 serves to provide displacement to the operating rod 6 of the contact block of the switch portion 112 shown in FIG. 15, and is rotatably supported to the support frame 11 via a cam shaft 4.

Around the outer circumferential surface of the cam plate 1, rectangular recesses 1*a*, 1*b* are formed in correspondence with the insertion holes 101*a* and 101*b* of the actuator, and in addition, between the two recesses 1*a* and 1*b*, lock grooves 1*c*, 1*d* are formed.

On the other hand, on both right and left sides of the plate cam 1, lock plates 2, 3 are arranged, respectively. To this pair of right and left lock plates 2, 3, inclined surfaces 2*a*, 3*a* and 2*b*, 3*b* are formed at the position opposite to the insertion holes 101*a* and 101*b*. At the top end portion on the front side, engaging pawls 2*c*, 3*c* for fitting into the lock grooves 1*c*, 1*d* of the cam plate 1 are formed.

The inclined surfaces 2*a*, 3*a* and 2*b*, 3*b* of each lock plate 2, 3 are surfaces tilted 45° with respect to inserting direction of the actuator, respectively, and are processed in a shape expanding outwards as they come closer to the insertion holes 101*a*, 101*b*, respectively. The inclined surfaces 2*a*, 3*a* and 2*b*, 3*b* are formed at positions corresponding to the pressurizing surface 121*b* of the protruded portion of the actuator 102.

Each of lock plates 2, 3 is rotatably supported to the support frame 11 via the spherical fulcrums 2*d*, 3*d* formed integrally to the bottom end of the rear side (switch portion 112 side) of the operating portion 111, and in addition, the posture shown in FIG. 3 through FIG. 5 is maintained by compression coil springs 5, 5 fitted into the clearance with the support frame 11, and by the support with these members. Each of the lock plates 2, 3 can rotate around two axes perpendicular to the rotation center of the cam plate 1, that is, around two axes parallel to the actuator inserting direction.

Next, referring to FIG. 7 through FIG. 10, the operation of the first embodiment will be described. FIG. 7 through FIG. 10 show the cases when the actuator 102 is inserted in the insertion hole 101*a* located on the front side, of the two insertion holes installed to the operating portion 111. FIG. 9 shows a view on the arrow Y of FIG. 3 as is the case of FIG. 6, and FIG. 10 is a view as seen from the actuator inserting direction (front elevation), showing the condition in which the actuator is inserted to the insertion end.

When the actuator 102 enters the inside of the operating portion 111 through the insertion hole 101*a*, first of all, the pressurizing surface 121*b* of the protruded portion at the top end comes in contact with the inclined surfaces 2*a*, 3*a* of lock plates 2, 3 (FIG. 9). At this point, the pressurizing surface 121*a* of the recess of the actuator does not come in contact with the cam plate 1.

Figure 7:
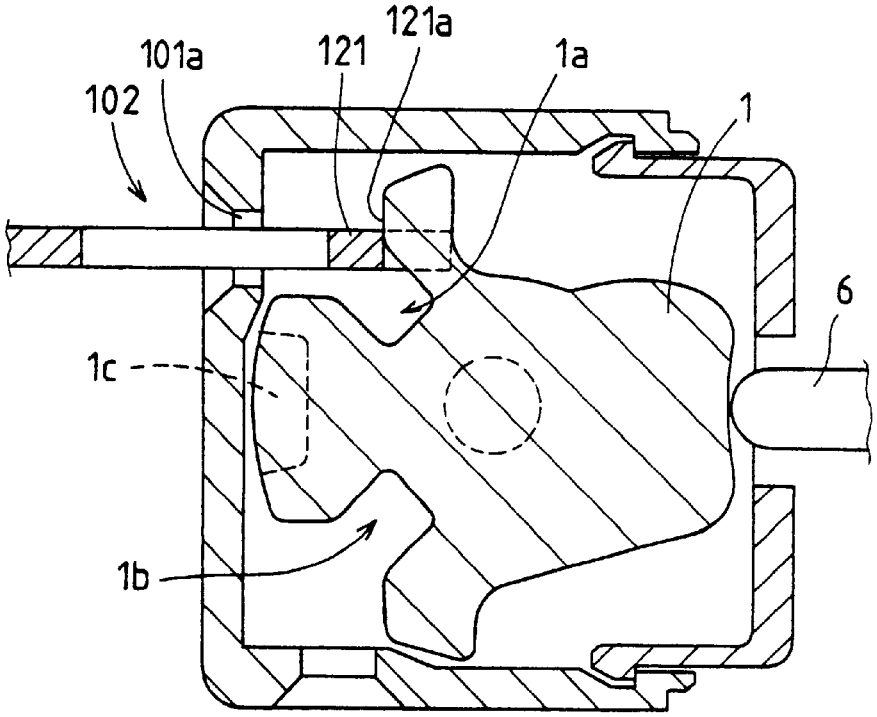
FIG. 7 illustrates the operation of the first embodiment when the actuator is inserted into the insertion hole in the front of the operating portion.

When the actuator 102 advances from this condition, the inclined surfaces 2*a*, 3*a* of lock plates 2, 3 are pressed in response to this advancement, and after the lock plates 2, 3 instantaneously open outwards with the fulcrums 2*d*, 3*d* as a center (axis intersecting the actuator inserting direction), lock plates 2, 3 are held to parallel position by the elastic force of compression coil springs 5, 5, and when the actuator 102 further advances, lock plates 2, 3 open outwards this time with the axis which passes the center of fulcrums 2*d*, 3*d* and is parallel to the actuator inserting direction as shown in FIG. 10, and with this action, engaging pawls 2*c*, 3*c* come off from lock grooves 1*c*, 1*d* of the cam plate 1, respectively and the cam plate 1 is unlocked, and at the same time, the pressurizing surface 121*a* of the recess of the actuator 102 comes in contact with the cam plate 1 as shown in FIG. 7 to rotate the cam plate 1.

In response to this rotation of the cam plate 1, the operating rod 6 of the switch portion 112 advances, and the contact changes over when the actuator 102 advances to the insertion end and at the same time the pressurizing piece 121 of the actuator fits into the recess 1*a* of the cam plate 1.

In the foregoing operation, when lock plates 2, 3 open outwards, compression coil springs 5, 5 are held compressed between lock plates 2, 3 and the support frame 11.

Figure 8:
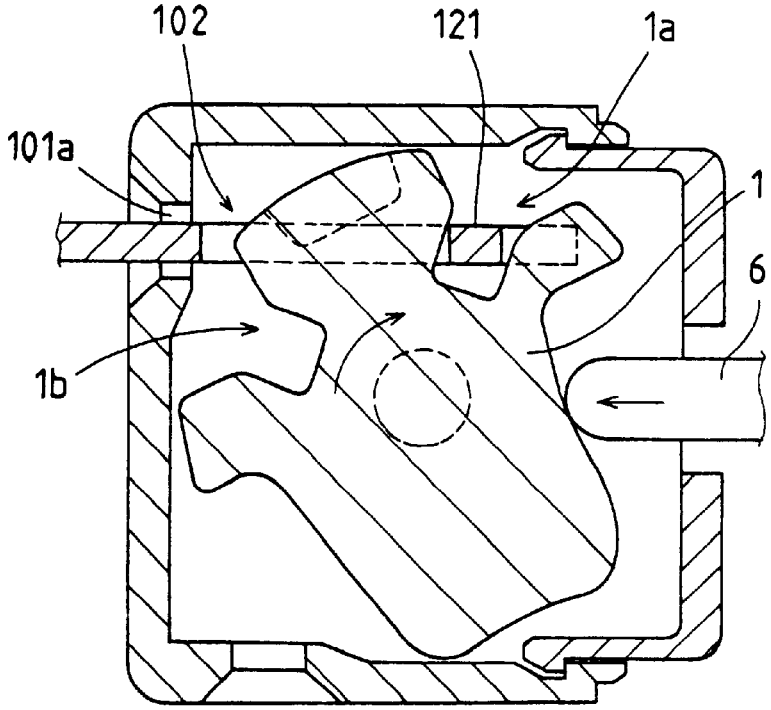
FIG. 8 illustrates the operation of the first embodiment after the actuator is inserted into the insertion hole in the front of the operating portion.
Figure 9:
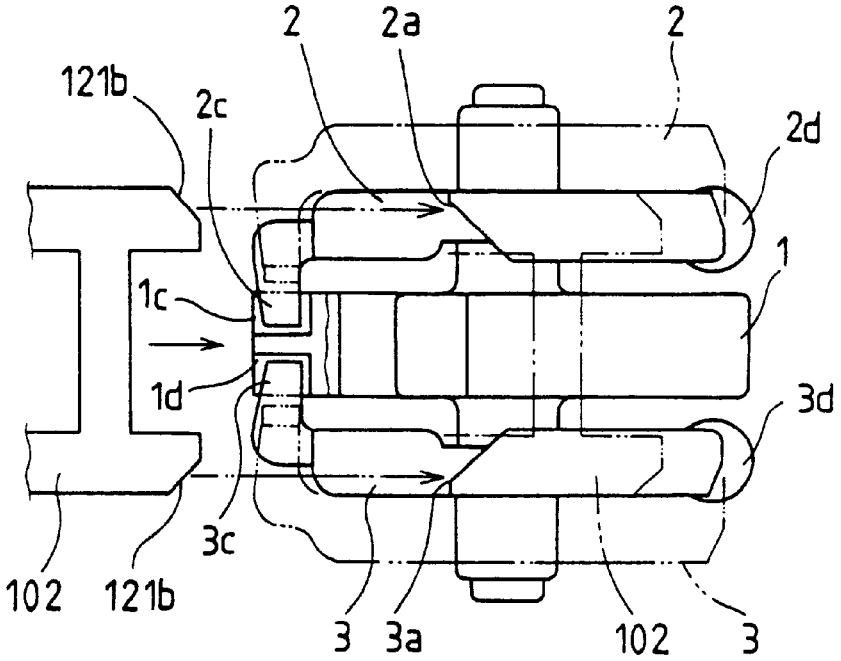
FIG. 9 illustrates a view from the position of arrow Y shown in FIG. 3.
Figure 10:
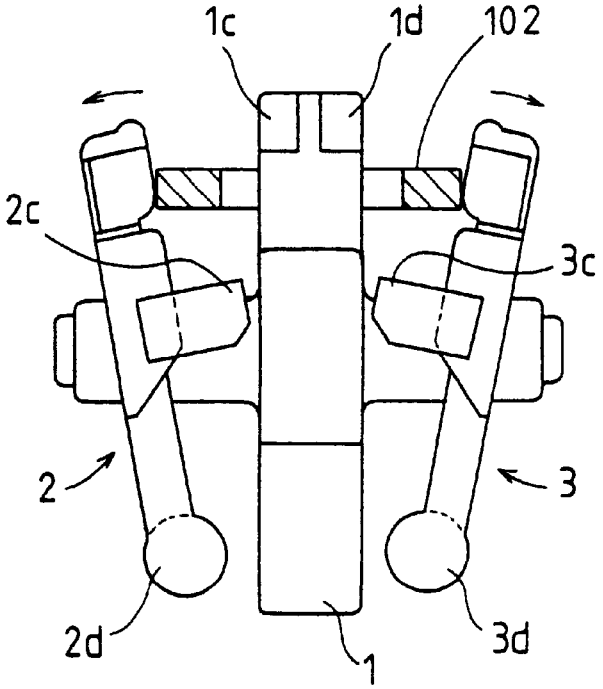
FIG. 10 illustrates a front elevation view of the first embodiment as seen from the actuator inserting direction.

Then, when the actuator 102 is removed from the condition of FIG. 8 and FIG. 10, reversing motion of the actuator 102 causes the cam plate 1 to rotate reversibly from the previous condition, and in response to this, the operating rod 6 reverses and the contact is changed over, and the lock grooves 1*c*, 1*d* of the cam plate 1 returns to the original position, that is, the position shown in FIG. 7 and FIG. 9, and lock plates 2, 3 returns to the original position (lock position) by the elastic force of compression coil spring 5, and the rotation of the cam plate 1 is restricted by fitting of engaging pawls 2*c*, 3*c* of lock plates into lock grooves 1*c*, 1*d*, respectively.

Figure 13:
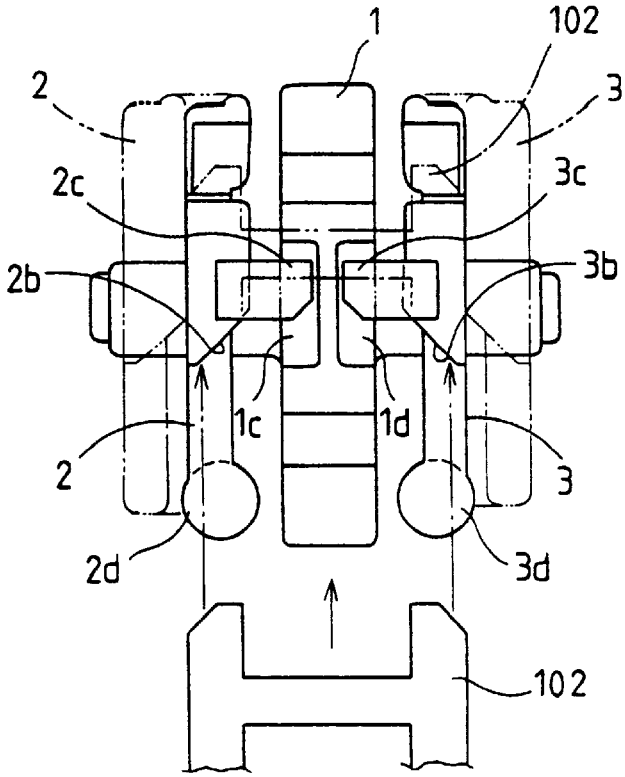
FIG. 13 corresponds to the first elevation of FIG. 4.
Figure 14:
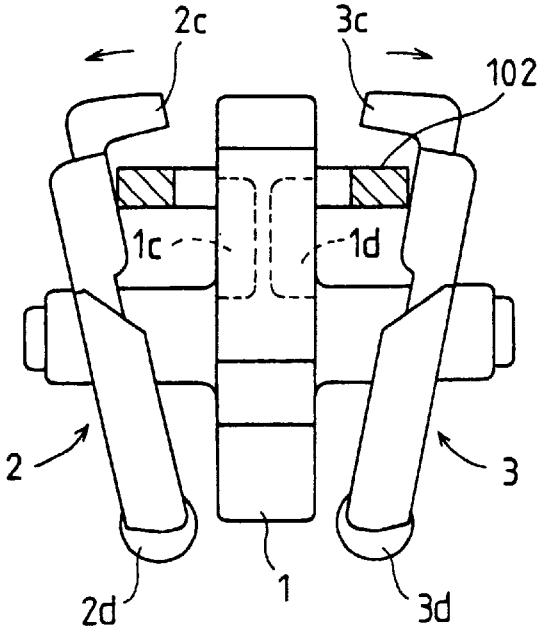
FIG. 14 illustrates a bottom plan view of the condition in which the actuator is inserted to the insertion end.

FIG. 11 through FIG. 14 illustrate operations when the actuator 102 is inserted into the other insertion hole 101*b*. FIG. 13 corresponds to the front elevation of FIG. 4, and FIG. 14 is a view as seen from the inserting direction of the actuator (bottom plan view) showing the condition in which the actuator is inserted to the insertion end.

In this case, the same as before, when the actuator 102 enters the inside of the operating portion 111 through the insertion hole 101*b*, first of all, the top end of the actuator 102 comes in contact with the inclined surfaces 2*b*, 3*b* of lock plates 2, 3 (FIG. 13), then, the lock plates 2, 3 open outwards with the fulcrums 2*d*, 3*d* set as a center (axis parallel to the actuator inserting direction) (FIG. 14), and engaging pawls 2*c*, 3*c*, come off from lock grooves 1*c*, 1*d* of the cam plate 1, respectively, and the cam plate 1 is unlocked.

Figure 11:
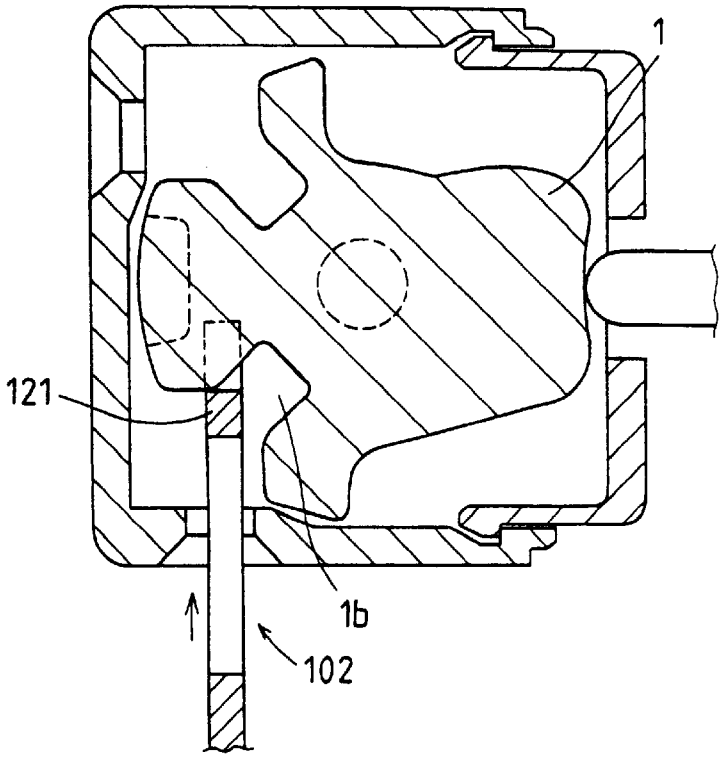
FIG. 11 illustrates the operation of the first embodiment when the actuator is inserted into the insertion hole in the side of the operating portion.
Figure 12:
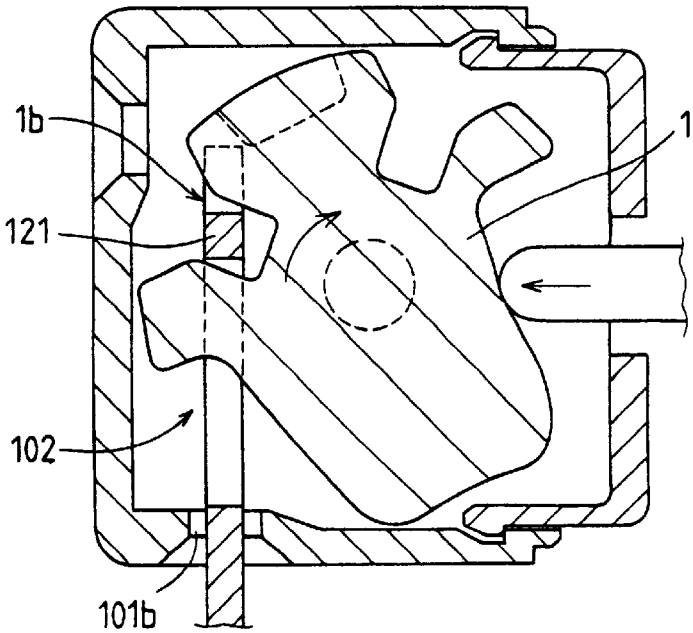
FIG. 12 illustrates the operation of the first embodiment after the actuator is inserted into the insertion hole in the side of the operating portion.

In response to this, the pressurizing surface 121*a* of the recess of the actuator 102 comes in contact with the cam plate 1 to rotate the cam plate 1 as shown in FIG. 11, and in accord with the rotation of this cam plate 1, the operating rod 6 of the switch portion 112 advances to change over the contact, and at the same time, the pressurizing piece 121 of the actuator 102 fits into the recess 1*b* of the cam plate 1.

The operation when the actuator 102 is pulled out is the same as that described before and the description will be omitted.

Figure 16:
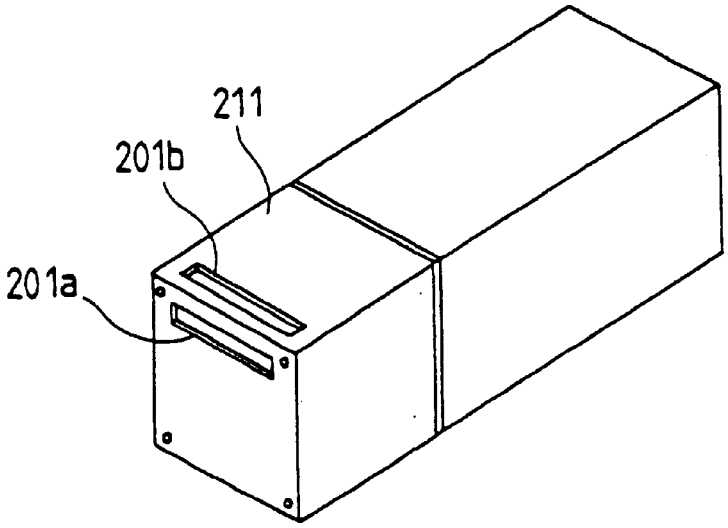
FIG. 16 is an external view in perspective of a second embodiment of the present invention.

Now, because in the foregoing embodiment, lock plates 2, 3 are designed to be rotatable around two axes which are perpendicular to each other. Thereby suitably varying the position and the quantity of the recesses and lock grooves formed on the outer circumferential surface of the cam plate 1 can change the inserting direction of the actuator 102, and for example, as shown in FIG. 16, actuator insertion holes 201*a* and 201*b* can be provided at corners of the front and top surfaces of the operating portion 211.

Next discussion will be made of the second embodiment of the present invention.

Figure 17:
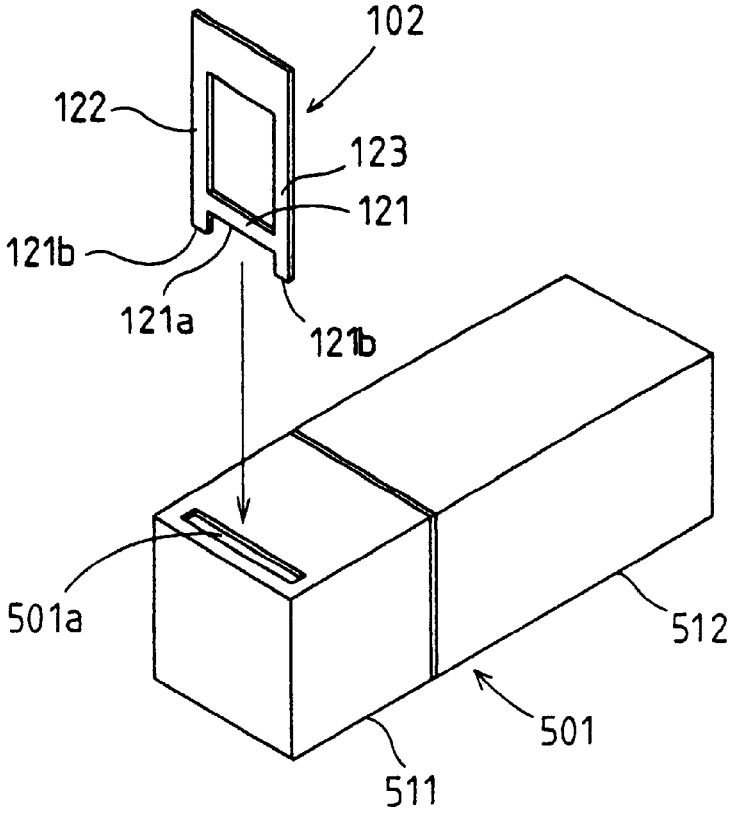
FIG. 17 is an external view in perspective of the second embodiment.
Figure 18:
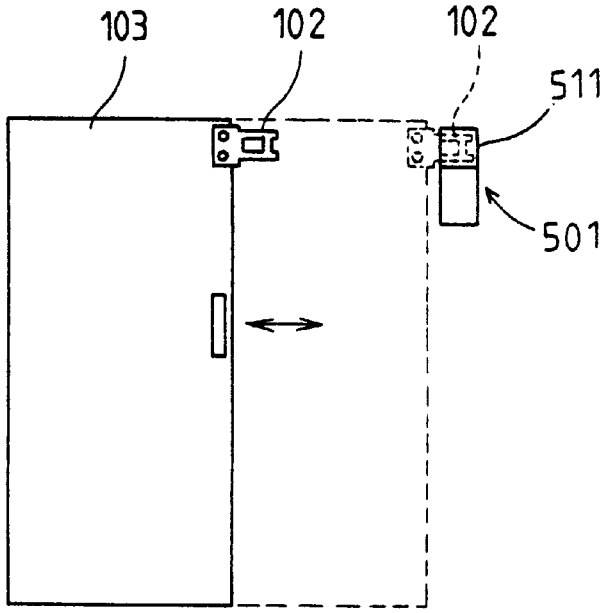
FIG. 18 shows the application condition of the second embodiment.

FIG. 17 is an external perspective view of the second embodiment of the present invention, and FIG. 18 shows the application condition of the second embodiment. First of all, referring to FIG. 17 and FIG. 18, the construction of the safety switch according to this second embodiment is briefly described.

The safety switch of this example is a switch electrically connected to the industrial machinery installed in a room, and primarily comprises a switch proper 501 and an actuator 102. The switch proper 501 is secured at the wall surface in the circumference of the doorway of the room and the actuator 102 is secured at a door 103. The actuator 102 is located at the position opposite to the insertion hole 501*a* of the switch proper and enters the operating portion 511 of the switch proper 501 when the door 103 is closed.

Figure 26A:
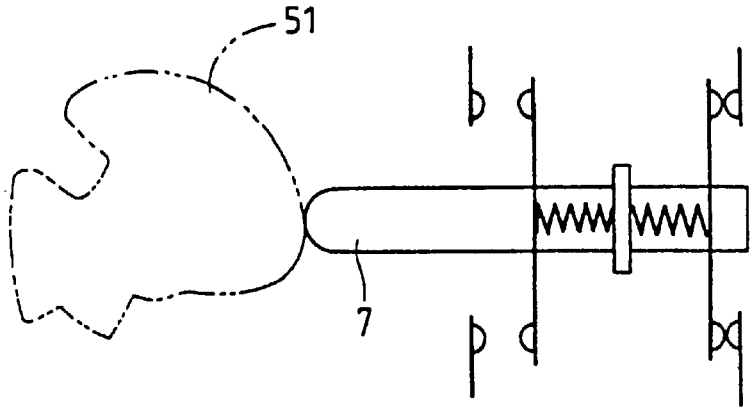
FIG. 26(A) and FIG. 26(B) schematically show a configuration example of the contact block of the switch portion 512 of the second embodiment.
Figure 26B:
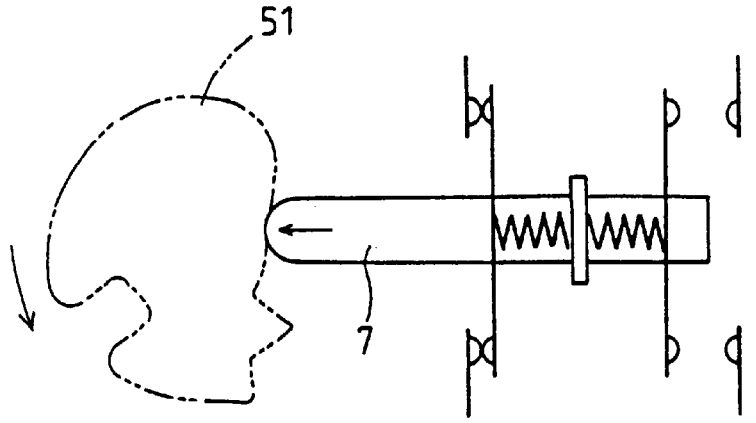

And the entry of the actuator 102 changes over the contact of the contact block (see FIG. 26) built in the switch portion 512, and the machinery inside the room is ready for operation. On the other hand, when the actuator 102 is removed from the operating portion 511 by the opening of the door 103, the contact for power supply is changed over and the power supply to the machine is turned off.

The actuator 102 same as that used for the first embodiment is used and the description is omitted here.

Figure 19:
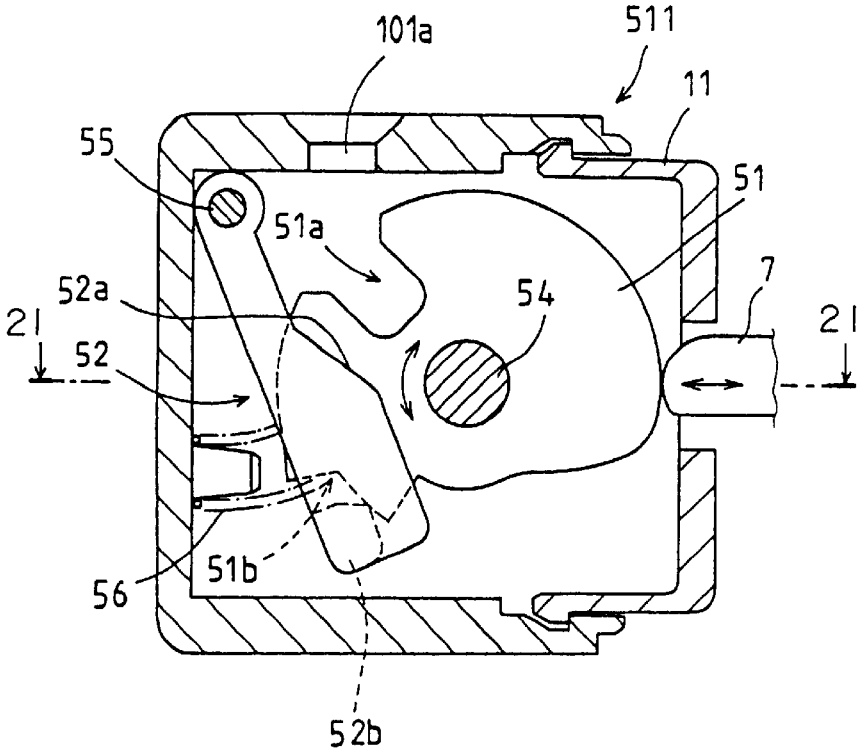
FIG. 19 is a side view showing the construction of the operating portion 511 with a cover partly broken away of the second embodiment.
Figure 20:
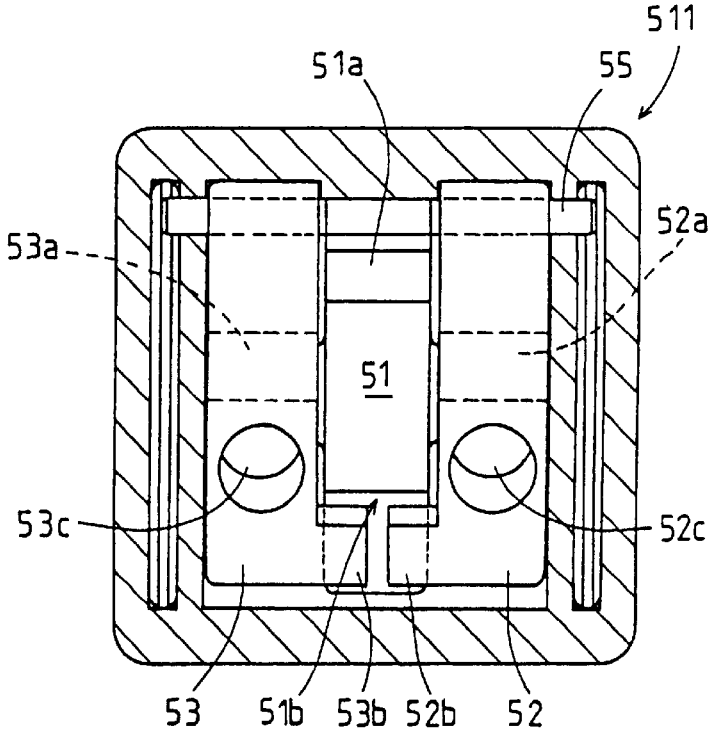
FIG. 20 is a front elevation showing the construction of the operating portion 511 with a cover partly broken away of the second embodiment.
Figure 21:
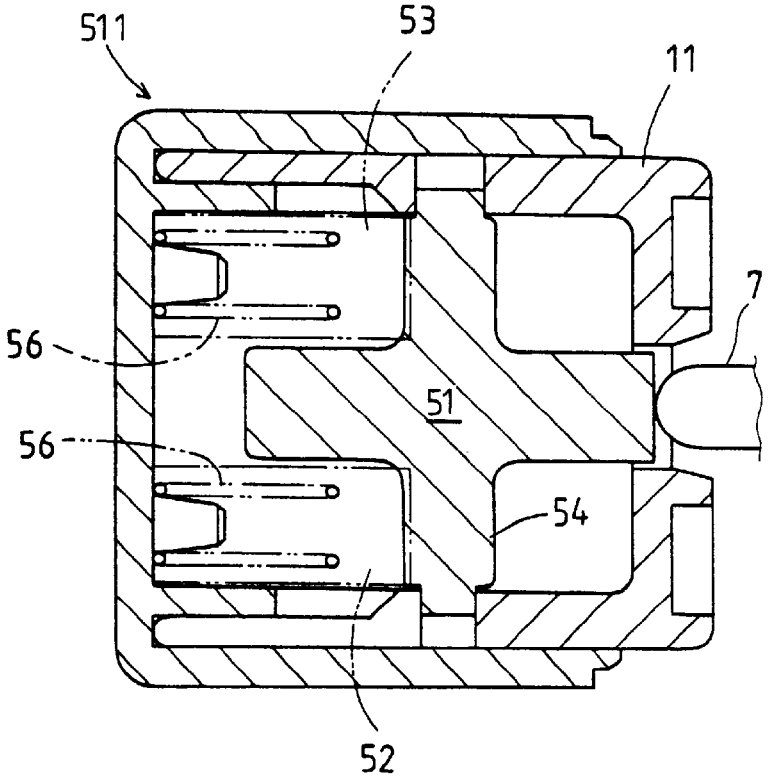
FIG. 21 is a cross-sectional view taken on the lines 21—21 of FIG. 19.
Figure 22:
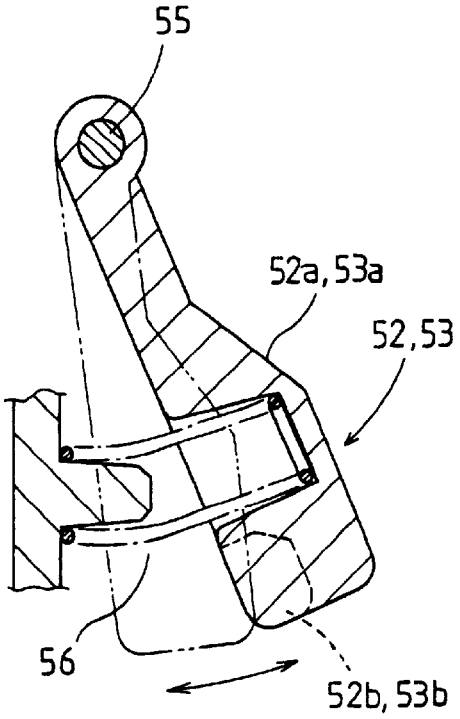
FIG. 22 is an enlarged view showing the lock piece extracted.

Referring now to FIG. 19 through FIG. 22 the mechanism of the operating portion of this embodiment will be described in detail hereinafter. FIG. 19 and FIG. 20 are a side view and front elevation view with the cover broken away, respectively. FIG. 21 is a view taken on the line 21—21 and FIG. 6 is an enlarged view with the lock piece extracted.

To the center of the operating portion 511, a cam plate 51 is mounted. This cam plate 51 serves to provide displacement to the operating rod 7 of the contact block shown in FIG. 26, and is rotatably supported to the support frame 11 via a cam shaft 54.

Around the periphery of the cam plate 51, rectangular recesses 51*a* to which a pressurizing piece 121 of the actuator 102 fits in is formed toward the direction of the cam shaft 54, and in addition, lock stepped portion 51*b* is formed at the position about 80° rotated from the recess 51*a*.

On both right and left sides of the cam plate 51, lock pieces 52, 53 are arranged, respectively. On both right and left sides of the cam plate 51, lock pieces 52, 53 are arranged, respectively. This pair of right and left lock pieces 52, 53 are mounted to the corner portion of the operating portion 511 and rotatably supported to the shaft 55 parallel to the rotation center (cam shaft 54) of the cam plate 51, and to each top end portion, engaging pawls 52*b*, 53*b* for latching the lock stepped portion 51*b* of the cam plate 51 are integrally formed.

On each of the lock pieces 52, 53, inclined surfaces 52*a*, 53*a* are formed at the position opposite to the insertion hole 501*a*. These inclined surfaces 52*a*, 53*a* are surfaces tilted to the inserting direction of the actuator 102, and is formed at the position corresponding to the pressurizing surface 121*b* of the protruded portion of the actuator 102.

In addition, to each of lock pieces 52, 53, spring holders 52*c*, 53*c* are mounted, and by the compression coil spring 56 (see FIG. 22) fitted into the spring holders 52*c*, 53*c*, the engaging pawls 52*b*, 53*b* of the lock pieces 52, 53 are pressurized against the outer circumferential surface of the cam plate 51.

Under the foregoing construction, when the actuator 102 is not inserted in the operating portion 511, as shown in FIG. 19, the recess 51*a* of the cam plate is located at the position opposite to the insertion hole 501*a* of the actuator, and engaging pawls 52*b*, 53*b* of lock pieces 52, 53 come in contact with the forward side of the lock stepped portion 51*b*, and the engaging pawls 52*b*, 53*b* oppose the lock stepped portion 51*b*, and even if the cam plate 51 only is attempted to rotate under this condition, engaging pawls 52*b*, 53*b* latch the lock stepped portion 51*b* and their rotation is prevented.

Next, referring to FIG. 23 through FIG. 25, the operation of the second embodiment will be described.

Figure 23:
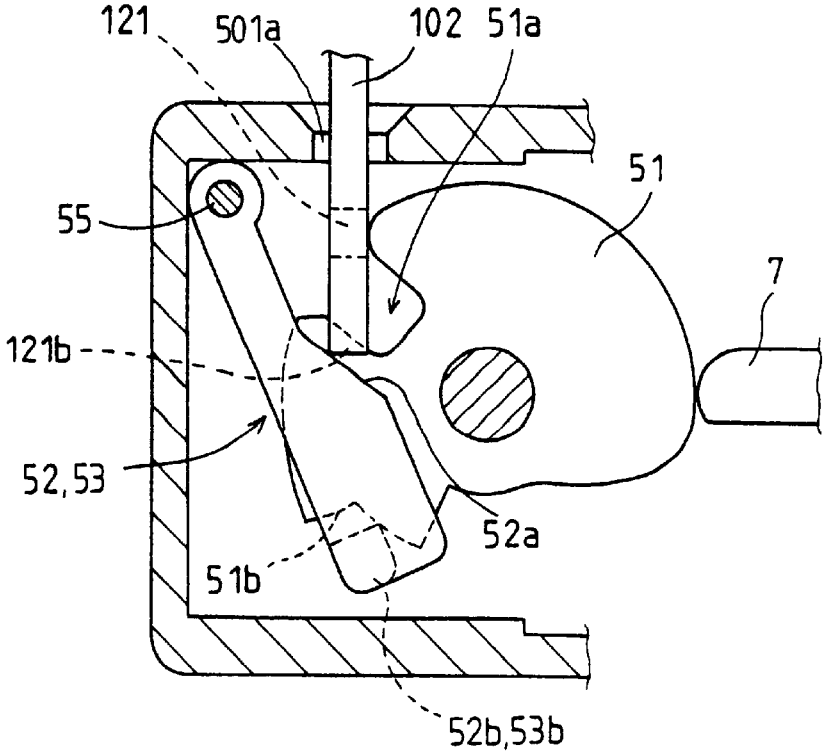
FIG. 23 illustrates the operation of the second embodiment.

When the actuator 102 enters the inside of the operating portion 511 through the insertion hole 501*a*, first of all, the pressurizing surface 121*b* of the protruded portion at the top end comes in contact with the inclined surfaces 52*a*, 53*a* of lock pieces 52, 53 (FIG. 23). At this point, the pressurizing surface 121*a* of the recess of the actuator 102 does not enter the inside of the recess 51*a* of the cam plate 51 and is located at the rear side of the recess 51*a*.

Figure 24:
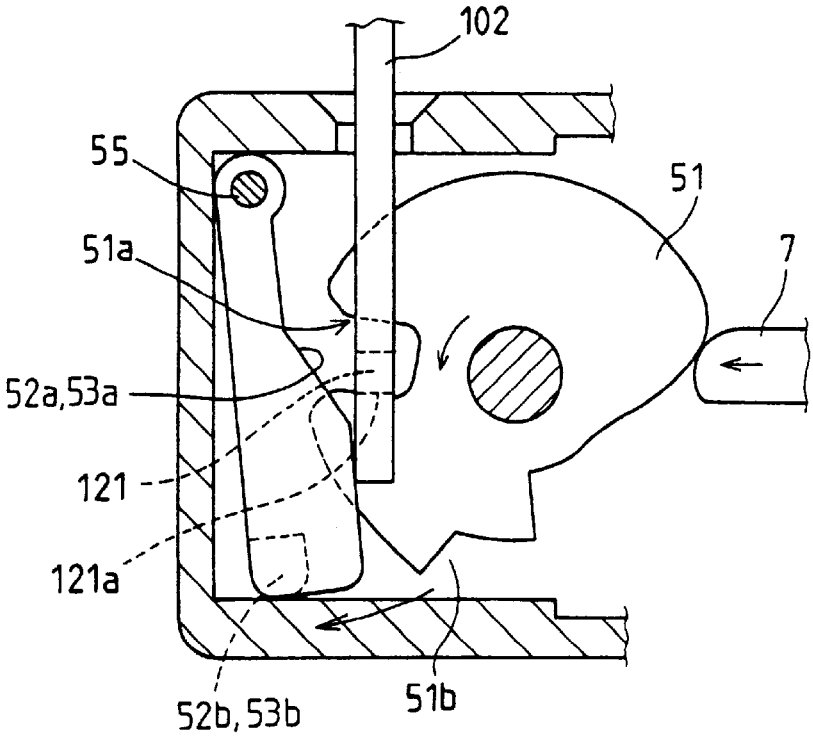
FIG. 24 illustrates the operation of the second embodiment.
Figure 25:
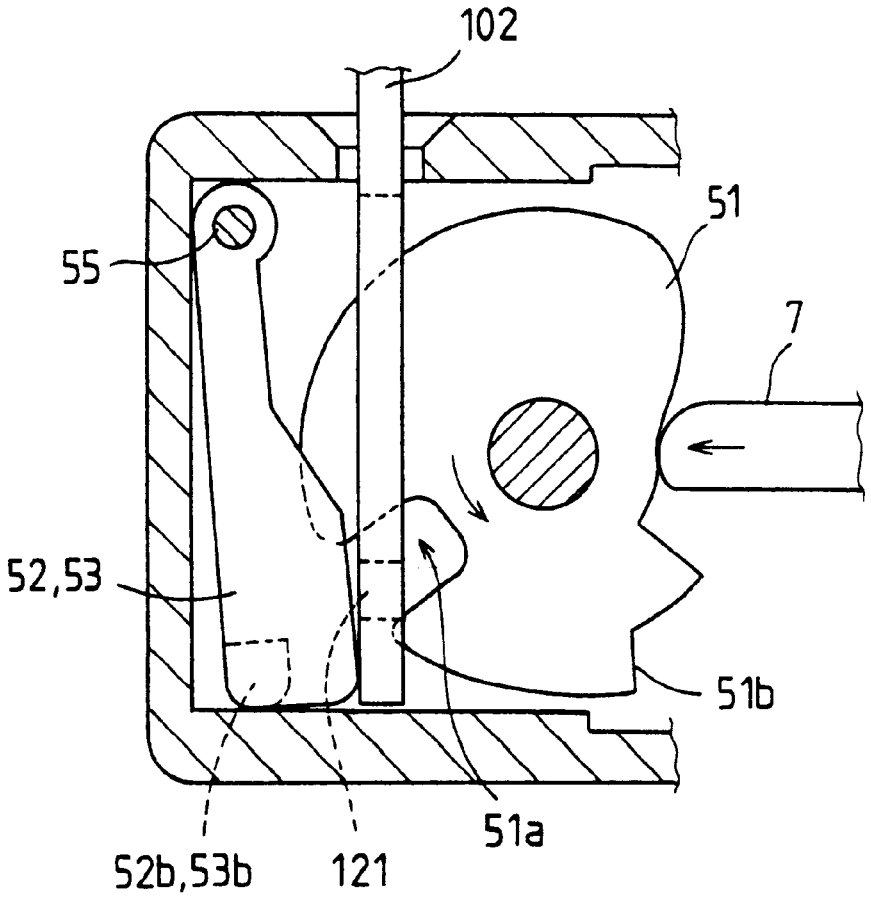
FIG. 25 illustrates the operation of the second embodiment.

When the actuator 102 further advances, the inclined surfaces 52*a*, 53*a* of lock pieces 52, 53 are pressed in response to this advancement, and as shown in FIG. 24, lock pieces 52, 53 rotate around the shaft 55, and by this action, engaging pawls 52*b*, 53*b* come off from the cam plate 51, move to the position free from interference with the lock stepped portion 51*b* and the cam plate 51 is unlocked, and at the same time, the pressurizing piece 121 of the actuator 102 fits into the recess 51*a* of the cam plate 51, and pressing of the pressurizing surface 121*a* against the inner surface of the recess 51*a* causes the cam plate 51 to rotate (FIG. 25). In response to the rotation of this cam plate 51, the operating rod 7 of the contact block advances, and when the actuator 102 advances to the insertion end, the contact of the contact block (FIG. 26) is changed over. With the actuator 102 advancing to the insertion end, the pressurizing piece 121 is located on the forward side of the recess 51*a* of the plate 51.

Then, when the actuator 102 is removed from the condition of FIG. 25, reversing motion of the actuator 102 causes the pressurizing piece 121 to fit in the recess 51*a* of the cam plate 51 to press the recess inner surface; then, the cam plate 51 begins to rotate reversibly from the previous condition, and in response to this, the operating rod 7 reverses and the contact recovers the original condition, and at the same time, the lock stepped portion 51*b* of the cam plate 51 returns to the original position, that is, the position shown in FIG. 19, and lock pieces 52, 53 return to the original position (lock position) by the elastic force of compression coil spring 56, and the rotation of the cam plate 51 is restricted.

In the foregoing embodiment, the insertion hole 501*a* of the actuator is provided on the top surface side of the operating portion 511, but the position of the insertion hole 501*a* may be brought to the front side of the operating portion 511 by suitably changing the position of the recess and lock stepped portion formed on the outer circumferential surface of the cam plate 51.

Under the foregoing two embodiments, by the elastic force of spring (not shown), the operating rods 6, 7 are constantly pressurized against the outer circumferential surface of the cam plates 1, 51, respectively. In addition, in the foregoing embodiments, the cam plates 1, 51 serve to provide displacement to the operating rods 6, 7, directly, but medium members may be arranged between the operating rod 6 and the cam plate 1, or between the operating rod 7 and the cam plate 51, respectively. In the construction according to this, the operating rods 6, 7 may serve to provide displacement, indirectly.

What is claimed is:

1. A safety switch comprising:

an actuator having an inserting portion which enters an operating portion of the switch to move an operating rod of a switch portion, thereby changing over a contact, where the inserting portion comprises a pressurizing piece as well as two supporting pieces which support both ends of the pressurizing piece and, each said supporting piece having one end protruding ahead of the pressurizing piece, wherein the operating portion comprises:

a cam plate which rotates in response to the entry of the actuator to displace the operating rod and which has a recess and a lock groove into which the actuator pressurizing piece fits formed on an outer circumferential surface of the cam plate;

a support frame for supporting both ends of a cam shaft for rotatably supporting said cam plate;

a first lock plate located on a side of the cam plate and rotatable around either one of two perpendicular axes and having an inclined surface tilted in an actuator inserting direction;

an engaging pawl fitted into the lock groove formed in the cam plate; and a spring fitted between the first lock plate and the support frame, wherein, whenever the actuator is not inserted in the operating portion, the first lock plate is held in a locked position by the spring, and the engaging pawl is fitted into the lock groove of the cam plate to restrict rotation of the cam plate, and when the actuator enters, a tip-end protrusion of the supporting piece comes in contact with the inclined surface to cause the first lock plate to open outwards around an axis parallel to the actuator inserting direction, thereby releasing a locked condition of the cam plate achieved by the engaging pawl, and at the same time the cam plate is rotated by the actuator pressurizing piece which fits into the recess formed on the outer circumferential surface of the cam plate.

2. A safety switch according to claim 1, further comprising a second lock plate, wherein the first and second lock plates are provided on both sides of the cam plate.

3. A safety switch according to either claim 1 or 2, wherein the operating portion includes two actuator insertion holes whose actuator inserting directions are perpendicular to each other, and insertion of the actuator into either one of the two insertion holes can release restriction to rotation of the cam plate by the engaging pawl.

4. A safety switch comprising:

an actuator having an insertion portion which enters an operating portion of the switch to move an operating rod of a switch portion, thereby changing over a contact, where an inserting portion comprises a pressurizing piece as well as two supporting pieces which support both ends of the pressurizing piece, each said supporting piece having one end protruding ahead of the pressurizing piece, wherein the operating portion comprises:

a cam plate which rotates in response to the entry of the actuator to displace the operating rod and which has a recess and a lock stepped portion into which the actuator pressurizing piece fits formed on an outer circumferential surface of the cam plate;

a first lock plate located on a side of the cam plate and rotatably supported by a rotatable axis parallel to an axis of rotation of the cam plate, and having an inclined surface tilted in an actuator inserting direction;

an engaging pawl latching the lock stepped portion of the cam plate; and a spring pressurizing the engaging pawl against the outer circumferential surface of the cam plate, wherein, whenever the actuator is not inserted in the operating portion, the engaging pawl comes in contact with the lock stepped portion on the outer circumferential surface of the cam plate to restrict rotation of the cam plate, and when the actuator enters, a tip-end protrusion of the supporting piece comes in contact with the inclined surface to release a locked condition of the cam plate achieved by the engaging pawl, and at the same time the pressurizing piece presses an inner surface of the recess of the cam plate to allow the cam plate to rotate.

5. A safety switch according to claim 4, further comprising a second lock plate, wherein the first and second lock plates are provided on both sides of the cam plate.

* * * * *